US007130575B2

(12) United States Patent
Maruko et al.

(10) Patent No.: US 7,130,575 B2
(45) Date of Patent: Oct. 31, 2006

(54) IMAGE FORMING APPARATUS

(75) Inventors: Masami Maruko, Hachioji (JP); Susumu Okui, Hachioji (JP); Hideo Isohara, Hachioji (JP); Tomoo Suzuki, Machida (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 210 days.

(21) Appl. No.: 10/948,577

(22) Filed: Sep. 24, 2004

(65) Prior Publication Data

US 2005/0186000 A1 Aug. 25, 2005

(30) Foreign Application Priority Data

Feb. 19, 2004 (JP) ..... 2004-042450
Feb. 19, 2004 (JP) ..... 2004-042492

(51) Int. Cl.
*G03G 15/00* (2006.01)

(52) U.S. Cl. ..... 399/405; 400/642

(58) Field of Classification Search ..... 399/397, 399/400, 405; 400/625, 642, 645; 101/232
See application file for complete search history.

(56) References Cited

U.S. PATENT DOCUMENTS 5,636,929 A * 6/1997 Asano et al. ..... 400/641
5,826,143 A * 10/1998 Haneda et al. ..... 399/182
5,978,644 A * 11/1999 Sato et al. ..... 399/397
6,652,091 B1 * 11/2003 Tanno ..... 347/104
6,712,463 B1 * 3/2004 Matsumoto ..... 347/104
6,722,802 B1 * 4/2004 Teo et al. ..... 400/718
6,896,432 B1 * 5/2005 Ohyama ..... 400/642

* cited by examiner

*Primary Examiner*—Ren Yan
(74) *Attorney, Agent, or Firm*—Finnegan, Henderson, Farabow, Garrett & Dunner, L.L.P.

(57) ABSTRACT

An image forming apparatus includes: a fixing device that fixes the toner image onto the recording medium by applying heat and pressure; ejection rollers provided away from the fixing device for ejecting the recording medium; a guide provided on at least one part of a recording medium ejection path between the ejection rollers and the fixing device for guiding a conveyance of the recording medium; at least one spur provided on the guide, having a plurality of teeth on a circumference thereof; and a slit formed on the guide so that the plurality of teeth of the spur are protruded on a side of the recording medium ejection path through the slit, wherein the recording medium is conveyed from the fixing device by bringing the plurality of teeth of the spur into contact with a surface of the recording medium.

7 Claims, 6 Drawing Sheets

FIG. 4 ( a )
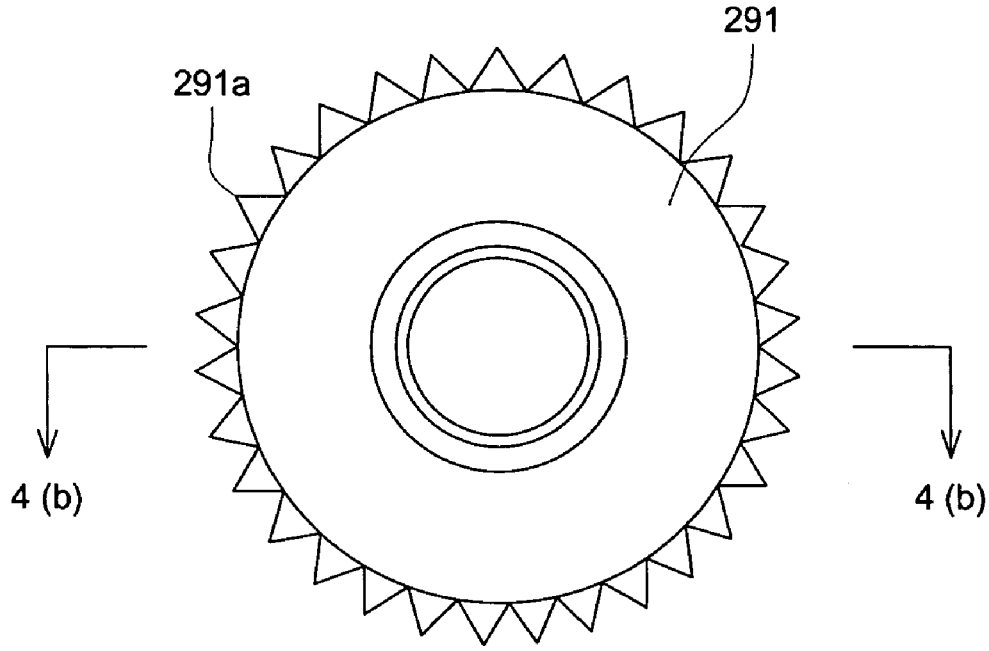
FIG. 4 ( b )
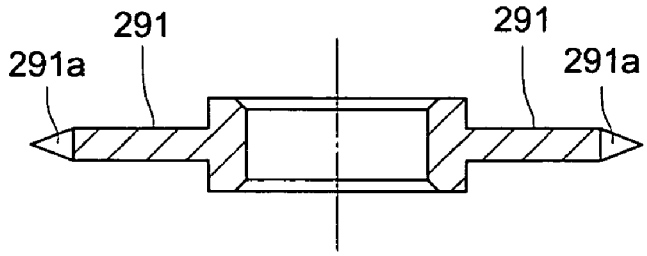

FIG. 5 ( a )
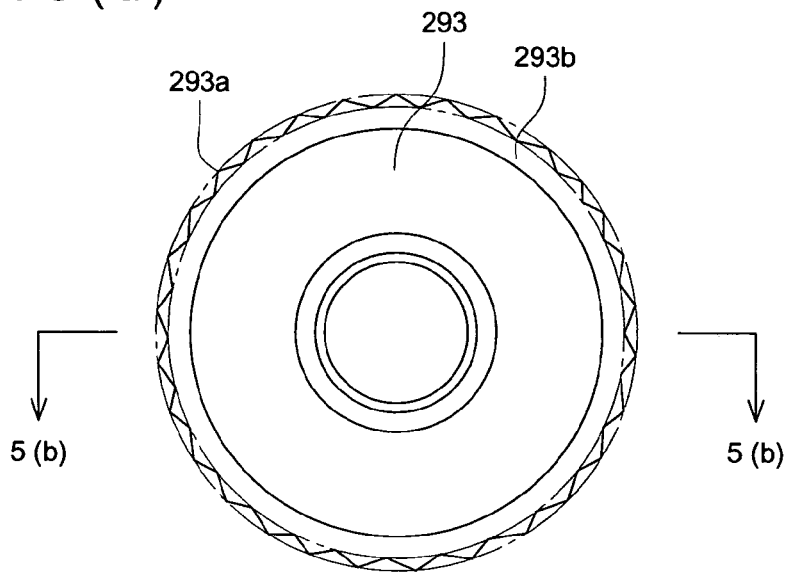
FIG. 5 ( b )
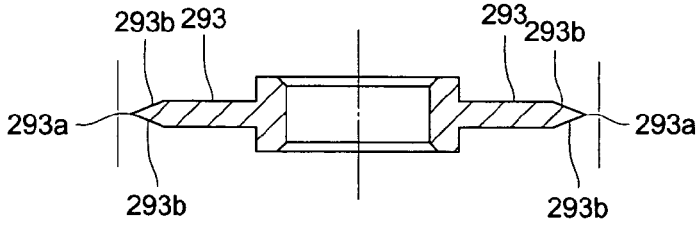
FIG. 5 ( c )
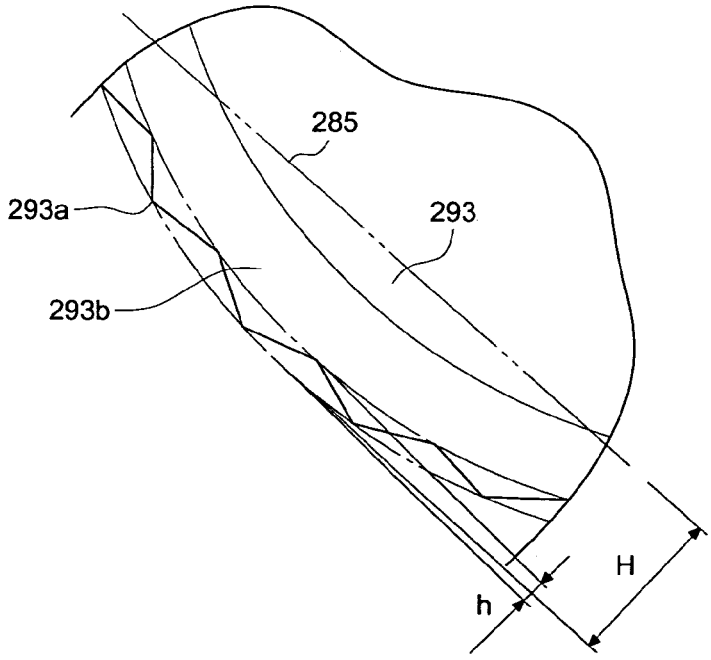

IMAGE FORMING APPARATUS

BACKGROUND OF THE INVENTION

The invention relates to an electrophotographic image forming apparatus such as copying machine, printer, facsimile, and so on of the electrophotographic type. Particularly, the invention relates to an image forming apparatus using toner that contains comparatively much wax.

A conventional electrophotographic image forming apparatus forms an image on a recording medium by the steps of charging the surface of an image carrier such as a photosensitive body with electricity, applying a laser beam to the electrically-charged surface in a scanning manner to form a latent image thereon, applying toner to the latent image by a developer to make it visible, heating, melting, and pressing the toner image by a fixing device to fix the toner image to a recording medium, and then ejecting the recording medium to the outside of the apparatus. The toner on the recording medium can be cooled and fixed thereto until the recording medium is ejected from the fixing device to the outside of the apparatus.

In case of forming a color image, toners of four colors (yellow, magenta, cyan, and black) are used. The image forming apparatus forms a toner image of each color on the related photosensitive body, transfers toner images of the colors onto an intermediate transfer body in a superposition manner, and further transfers the superimposed multi-color images to a recording medium. Therefore, a color image uses more toner than a black and white image. When the quantity of toner increases, the toner heated by the heating roller of the fixing device becomes harder to be separated from the heating roller. Then, wax is added to toner to make toners be separated from the heating roller easily. Wax in the toner can make color images glossy and consequently improve the image quality.

Usually, wax is set to be molten more easily than toner. Thus, wax is lower in melting and solidifying points than toner. Consequently toner is solidified immediately after it goes out from the fixing device, but wax is slow to be solidified.

The recording medium is carried by the ejection rollers to pass through an ejection path between the exit of the fixing device and the outside of the apparatus. This ejection path is not linear but curved with guide plates or the like so that the recording medium may travel a preset curved course before reaching the ejection roller.

When the recording medium touches the guide plates while wax is not solidified yet, the molten wax on the contact area of the recording medium is quickly cooled by it and solidified. However, wax on the other recording medium area is slow to be solidified.

Generally, wax contained in toner is glossy when the molten wax is cooled and solidified quickly but becomes dull when the molten wax is cooled gradually. Therefore, the wax on the contact area of the recording medium is immediately cooled and becomes glossy but the wax on the non-contact area of the recording medium is cooled slowly and becomes dull. The uneven glossiness on the recording medium reduces the image quality. To prevent this, the recording medium must be carried without being in contact with the guide plates or the like.

Patent Document 1, which represents Japanese Non-examined Patent Publication 2001-175112, discloses a method of transferring a recording medium without making the recording medium touch the guide plate or the like. In the description of Patent Document 1, the recording medium (a transfer sheet) passing through a nip area between the heating roller and the pressing roller of the fixing device is separated from the heating roller by separation claws provided near the heating roller. The transfer sheet is separated by the tip of each separation claw, slides on the surface of the claw to the ejection rollers, and then carried into the ejection tray. In this case, paper dust of the transfer sheet may remove the Teflon (registered trademark) coated layer. In extreme cases, toner may be caught in the area from which Teflon coat is removed and may give unwanted lines to the image on the transfer sheet or damage the transfer sheet. Patent Document 1 provides a spur on each separation claw so that the transfer sheet passing through the nip area between the heating roller and the pressing roller may not be in contact with the separation claws. Specifically, the transfer sheet separated from the heating roller by the separation claws is supported by the edges of the spurs away from the separation claws and sent to the ejection rollers. This mechanism keeps the transfer sheet away from the separation claws, prevents the Teflon coat from being damaged, and consequently prevents unwanted lines on the transfer sheet and damages of the transfer sheet.

Patent Document 2, which represents Japanese Non-examined Patent Publication H11-95489, as another prior art discloses a means provided in the ejection path between the image carrier and the fixing device. This means is to carry a transfer sheet having unfixed toner images on both sides. When the transfer sheet touches the guide plate or the like, the unfixed toner on the transfer sheet may be rubbed away by it. To prevent this, the invention provides spurs in the ejection path and supports the transfer sheet by a plurality of spur edges without carrying the transfer sheet on the guide plates. As the spurs rotate while the transfer sheet moves forward, the transfer sheet is supported by a plurality of spur edges and toner images on the transfer sheet will not be damaged.

Naturally, there are many parts other than the guide plates and the like that touch the molten wax on the transfer sheet. The transfer sheet is fed from the sheet cassette, carried along a preset conveyance path through the image forming apparatus, and finally ejected to the ejection tray. A plurality of sensors are disposed along this conveyance path. If a sensor does not detects the transfer sheet within a preset time period after the preceding sensor detected the transfer sheet, it is assumed that a paper jam has occurred. These sensors are helpful in detecting a paper jam earlier and enable easy and quick removal of the jam.

Each sensor has an actuator. When touching the leading edge of a transfer sheet, the actuator works to turn on the sensor to tell that the transfer sheet is detected. When the actuator touches molten wax on the transfer sheet, the wax is quickly cooled and solidified. This causes a glossy stripe on the transfer sheet.

However, in the above well-known example, the recording medium is kept away from the guide plates or the like before fixing or immediately after fixing. Contrarily, the molten wax is solidified near the ejection roller which is a little away from the fixing device. Therefore, this prior art cannot solve the unevenness of gloss of wax by a sensor provided just after the fixing device.

SUMMARY OF THE INVENTION

The present invention is devised from the above prior art and its object is to provide an image forming apparatus that can detect a recording medium which is wet with wax just after fixing, solidify the wax on the recording medium uniformly without causing any stripe of unevenness of wax gloss, and thus form images without unevenness.

The above object can be attained by any one of the structures (1) to (9) below.

Structure (1): An image forming apparatus comprising a fixing device that receives a recording medium having unfixed toner images, heats and presses the toner images formed on the recording medium, and fixes the toner images onto the recording medium, ejection rollers provided away from the fixing device, a sensor provided in the recording medium ejection path between the ejection rollers and the fixing device to detect the recording medium, an actuator of the sensor, and a spur having a plurality of teeth on its circumference that is provided on the tip of the actuator.

Structure (2): The image forming apparatus of structure (1), wherein the sensor is an optical sensor having a light emitter and a light receiver, the actuator is equipped with a light-shielding lever that moves between the light emitter and the light receiver, a medium detection lever which is rotated by the movement of the recording medium, and a shaft which holds both levers pivotally, and the medium detection lever is equipped with the spur on its tip.

Structure (3): The image forming apparatus of structure (1), wherein the rotary axis of the spur is located in the outer side of the ejection path through which the recording medium is carried.

According to Structure (1), the following operations and effects are produced.

The fixing device heats and melts toner on a recording medium to fix the toner to the recording medium and sends out the recording medium wet with the molten wax in the toner to the ejection path. In the ejection path, the recording medium reaches the actuator and touches the sharp edges of a spur provided on the tip of the actuator. The spur can rotate as the recording medium advances. Therefore, the spur supports the recording medium by points (sharp spur edges) and the molten wax is not cooled quickly. As the result, the molten wax on the recording medium can be solidified uniformly. Specifically, this structure has an excellent effect to prevent unevenness of gloss of wax that is formed because of differences in wax solidifying speeds.

According to Structure (2), the sensor is an optical sensor having a light emitter and a light receiver, the actuator is equipped with a light-shielding lever that moves between the light emitter and the light receiver, a recording medium detection lever which is rotated by the advance of the recording medium, and a shaft which holds both levers pivotally, and the medium detection lever is equipped with the spur on its tip.

Therefore, just when the recording medium touches and rotates the spur, the medium detection lever and the light shielding lever rotate. With this, the recording medium can be detected.

According to Structure (3), the rotary axis of the spur is located in the outer side of the ejection path through which the recording medium is conveyed. Therefore, the rotational direction of the spur that is made by the advance of a recording medium is equal to that of the detection lever. This enables a smooth detection of a recording medium.

Structure (4): An image forming apparatus comprising a fixing device that receives a recording medium having toner images, heats and presses the toner images formed on the recording medium, and fixes the toner images onto the recording medium, ejection rollers provided away from the fixing device to eject the recording medium, a guide means provided on at least one part of the recording medium ejection path between the ejection roller and the fixing device to guide the conveyance of the recording medium, one or more spurs having a plurality of teeth on its circumference that are provided on the tip of the guide means, and a slit formed on the guide means so that the plurality of teeth of the spur are protruded on a side of the recording medium ejection path through the slit, wherein the recording medium is conveyed from the fixing device toward the ejection rollers by bringing the plurality of teeth of the spur into contact with a surface of the recording medium.

Structure (5): The image forming apparatus of structure (4), wherein plural spurs are provided at a preset interval on a shaft that extends perpendicular to the conveyance direction of the recording medium.

Structure (6): The image forming apparatus of structure (5), wherein plural shafts are provided in parallel to each other along the conveyance direction.

Structure (7): The image forming apparatus of structure (6), wherein some of the spurs are characterized in that each tooth is more than 0.1 mm to less than 0.5 mm high and the projection from the surface of said guide means is 0.5 to 2 mm high.

Structure (8): The image forming apparatus of structure (7), wherein a plurality of spurs of a small projection are provided on an identical shaft.

Structure (9): The image forming apparatus of structure (8), wherein the ejection path has a normal-speed ejection path that carries the recording medium at an ordinary linear speed and a high-speed ejection path that carries the recording medium at a higher linear speed, these two ejection paths merge before the ejection roller, and the spur of a small projection is provided in the ejection roller side relative to the merging point.

According to Structure (4), the following operations and effects are produced.

The fixing device heats and melts toner on a recording medium to fix the toner to the recording medium and sends out the recording medium wet with the molten wax in the toner to the ejection path. In the ejection path, the recording medium is supported and carried by teeth of spurs provided on the guide means. After the molten wax on the recording medium is fully solidified, the recording medium reaches the ejection rollers and is ejected to the ejection tray. In this way, as the recording medium does not touch the guide means or the like directly between the time at which the medium comes out of the fixing device and the time at which the wax on the medium is fully solidified, the wax can be solidified uniformly. Specifically, this structure has an excellent effect to prevent unevenness of gloss of wax that is formed because of differences in wax solidifying speeds.

According to Structure (5), a plurality of such spurs are provided at a preset interval on a shaft that extends perpendicularly to the conveyance of the recording medium to support the recording medium at points across the conveyance of the recording medium and to prevent the recording medium from touching the guide means in places where no spurs are provided.

According to Structure (6), a plurality of the parallel shafts provided perpendicularly to the conveyance of the recording medium prevent the recording medium from touching the guide means until the molten wax is completely solidified even when the molten wax is slow to be solidified.

According to Structure (7), some of the spurs are characterized in that each tooth is more than 0.1 mm to less than 0.5 mm high and the projection from the surface of said means is 0.5 to 2 mm high. This can prevent the recording medium from being damaged even when the recording medium is transferred at a high speed.

According to Structure (8), a plurality of small-projected spurs are provided on an identical shaft and prevent the recording medium from touching the guide means between spurs.

According to Structure (9), the ejection path has a normal-speed ejection path that conveys the recording medium at an ordinary linear speed and a high-speed ejection path that conveys the recording medium at a higher linear speed, these two ejection paths merge before the ejection rollers, and the spur of a small projection is provided on the ejection roller side relative to the merging point.

The recording medium can be supported by spurs fully until the molten wax is solidified and this can prevent the recording medium from being damaged even when the recording medium is transferred at a high speed.

BRIEF DESCRIPTION OF THE DRAWINGS

FIG. 4(*a*) shows a front view of a large-projection spur and FIG. 4(*b*) shows a sectional view taken on line 4(*b*)—4(*b*) in FIG. 4(*a*).

FIG. 5(*a*) shows a front view of a small-projection spur and FIG. 5(*b*) shows a sectional view taken on line 5(*b*)—5(*b*) in FIG. 5(*a*). FIG. 5(*c*) shows a magnified view of part of FIG. 5(*a*).

DETAILED DESCRIPTION OF THE PREFERRED EMBODIMENTS

The fixing device and the image forming apparatus of the invention will be explained with reference to the accompanying drawings.

Figure 1:
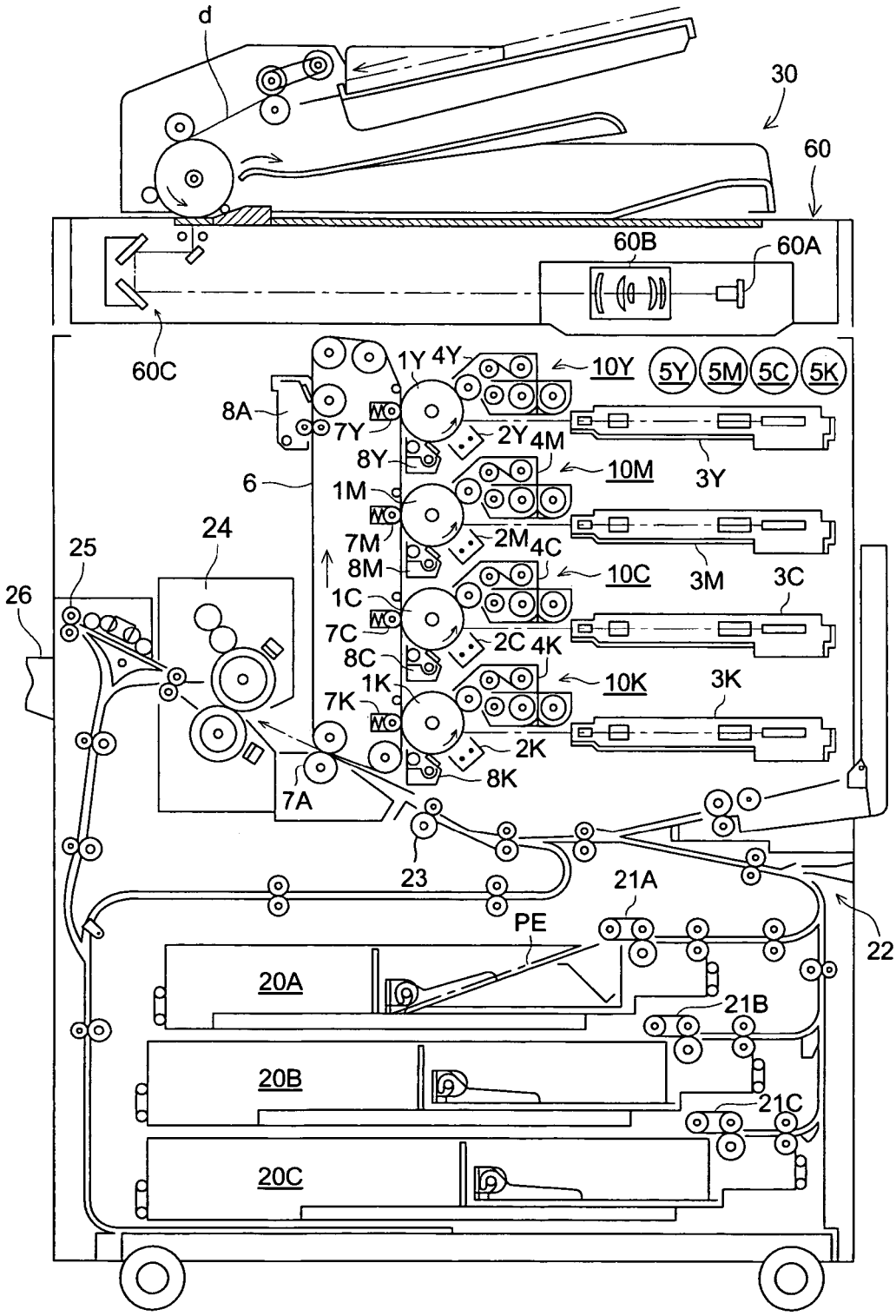
FIG. 1 shows the cross-sectional view of the configuration of a color image forming apparatus, which is an embodiment of the invention.

FIG. 1 shows the cross-sectional view of the configuration of a color image forming apparatus which is an embodiment of the invention. Although FIG. 1 is a view of a color image forming apparatus, the invention can be applied to all image forming apparatus that use toners containing wax. Naturally, the invention can also be applied to monochromatic image forming apparatus.

The color image forming apparatus A of FIG. 1 is a tandem type color image forming apparatus has an automatic document feeder 30, an image reader 60, image writers (3Y, 3M, 3C, and 3K), image carriers (1Y, 1M, 1C, and 1K), chargers (2Y, 2M, 2C, and 2K), developers (4Y, 4M, 4C, and 4K), a fixing device 24, a belt-like intermediate transfer body 6, paper feeding means (21A, 21B, and 21C), and a paper conveyance system 22. Toner supplying means (5Y, 5M, 5C, and 5K) respectively supply new toners to the corresponding developers (4Y, 4M, 4C, and 4K).

The automatic document feeder 30 is a means to automatically feed single- or double-sided documents "d". The image reader 60 reads image information by a moving optical system which scans the contents of a plurality of documents "d" fed from the document tray, reflects them by three moving mirrors 60C, and focuses the reflections into an image pickup element 60A made of CCDs by a condenser lens 60B.

The image forming section 10Y to form a yellow image has a charger 2Y, an image writer 3Y, a developer 4Y, and a cleaner 8Y that are placed around the image carrier 1Y. The image forming section 10M to form a magenta image has an image carrier 1M, a charger 2M, an image writer 3M, a developer 4M, and a cleaner 8M. The image forming section 10C to form a magenta image has an image carrier 1C, a charger 2C, an image writer 3C, a developer 4C, and a cleaner 8C. The image forming section 10K to form a magenta image has an image carrier 1K, a charger 2K, an image writer 3K, a developer 4K, and a cleaner 8K.

Sets of charger 2 and image writer 3 (2Y and 3Y, 2M and 3M, 2C and 3C, and 2K and 3K) respectively form a latent image forming means.

The intermediate transfer body 6 is an endless belt which is entrained about and supported to rotate by a plurality of rollers and driven by a motor (not shown in the drawing).

A signal of information of an image focused on the image pickup element 60A is sent to an image processor (not shown in the drawing). The image processor performs analog processing, A/D conversion, shading correction, and image compression on the signal and sends the processed signals by colors to the corresponding image writers (3Y, 3M, 3C, and 3K).

Each of the image writers (3Y, 3M, 3C, and 3K) using a semiconductor laser as its laser source converts the laser beam from the semiconductor laser into a scanning laser beam by optical elements such as a polygon mirror according to the signals sent from the image processor and forms an electrostatic latent image of each color on the corresponding image carrier (1Y, 1M, 1C, and 1K).

The images of colors formed by the image forming sections (10Y, 10M, 10C, and 10K) are transferred in sequence onto the moving intermediate transfer body 6 by the primary transfer devices (7Y, 7M, 7C, and 7K) to make a composite color image of them on the intermediate transfer body 6 (primary transferring). A transfer sheet PE as a recording medium is fed from the paper cassette (20A, 20B, or 20C), carried through the conveyance system 22, aligned by registration rollers 23, fed to the transfer device 7A which is a secondary transfer device, and receives a color image on it by transferring (secondary transferring). The transfer sheet PE having a transferred color image is fixed by the fixing device 24 and ejected by the ejection rollers 25 to the ejection tray 26 outside the image forming apparatus.

After transferring a color image onto the transfer sheet PE by the transfer device 7A and separating the transfer sheet PE, the intermediate transfer body 6 is cleaned by the cleaner 8A.

Figure 2:
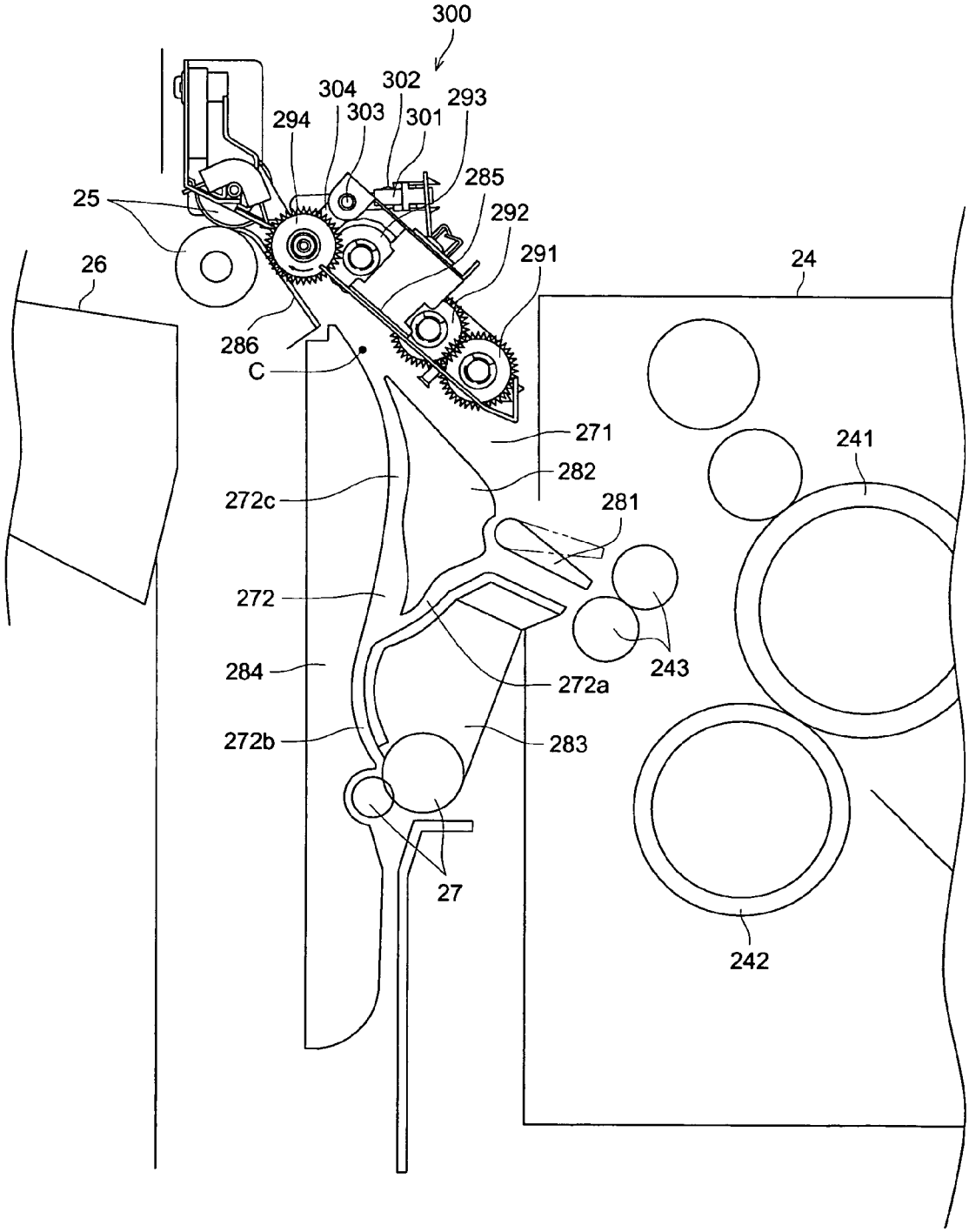
FIG. 2 shows a magnified view of a section between the fixing device and the ejection rollers of FIG. 1.

FIG. 2 shows a magnified view of a section between the fixing device 24 and the ejection rollers 25 of FIG. 1. The fixing device 24 has a heating roller 241 and a pressing roller 242 which presses the heating roller. The transfer sheet PE as a recording medium having a toner image on it passes through the nip area between the heating roller 241 and the pressing roller 242, have its toner image molten and fixed to the sheet PE, and sent toward the ejection rollers 25 by the delivery rollers 243.

A paper ejection path is provided between the delivery rollers 243 and the ejection rollers 25. This ejection path has a straight ejection path 271 and an inversion ejection path 272. A path changeover lever 281 is provided near the delivery rollers 243. One end of the lever 281 is pivotally supported by the guide block 282.

A guide member 283 is provided below the guide block 282, which has a guide wall 284 in the left side. Inversion rollers 27 are provided below them.

A guide plate 285 is provided above the guide block 282 and equipped with a plurality of spurs (291, 292, 293, and 294), which are characterized by the invention. Spurs 291 and 292 have a large projection and the spur 293 has a small projection. The spur 294 constitutes part of the sensor 300. These spurs (291, 292, 293, and 294) will be explained referring to another drawings.

The space between the guide block 282 and the guide plate 285 is used as a straight ejection path 271. An auxiliary guide plate 286 is provided opposite the guide plate 285 over a point C at which the straight ejection path 271 and the inversion ejection path 272 merge. It is smoothly connected to the nip section of the ejection roller 25.

In the above configuration, a set of the guide block 282, the guide member 283, the guide wall 284, the guide plate 285, and the auxiliary guide plate 286 is called a guide means.

The inversion ejection path 272 is composed of first, second, and third inversion ejection paths. The first inversion ejection path 272*a* is the space between the guide block 282 and the guide member 283. The second inversion ejection path 272*b* is the space between the guide member 283 and the guide wall 284. The third inversion ejection path 272*c* is the space between the guide block 282 and the guide wall 284.

When the changeover lever 281 is in the position indicated by a solid line, the transfer sheet PE sent from the delivery rollers 243 reaches the ejection rollers 25 through the straight ejection path 271 and directly ejected to the ejection tray 26.

When the changeover lever 281 is in the position indicated by a broken line, the transfer sheet PE sent from the delivery rollers 243 enters the first inversion ejection path 272*a* and the second inversion ejection path 272*b*, and then reaches the inversion rollers 27. The transfer sheet PE is nipped by the inversion rollers 27 and sent downwards in the drawing. When the trailing edge of the transfer sheet PE reaches the second inversion ejection path 272*b* and is detected by the sensor, the inversion rollers 27 stop and rotate backward. The transfer sheet PE starts to move with its trailing edge as the new leading edge, and keeps on going through the third inversion ejection path 272*c*, the merging point C, and the spurs 293 and 294. The transfer sheet PE is nipped by the ejection rollers 25 and ejected to the ejection tray 26. In this case, the ejected transfer sheet PE is already turned over. In this case, if the transfer sheet PE with an image upward is conveyed through the straight ejection path 271, the transfer sheet with the image downward is conveyed through the inversion ejection path 272 (upside down).

Figure 3:
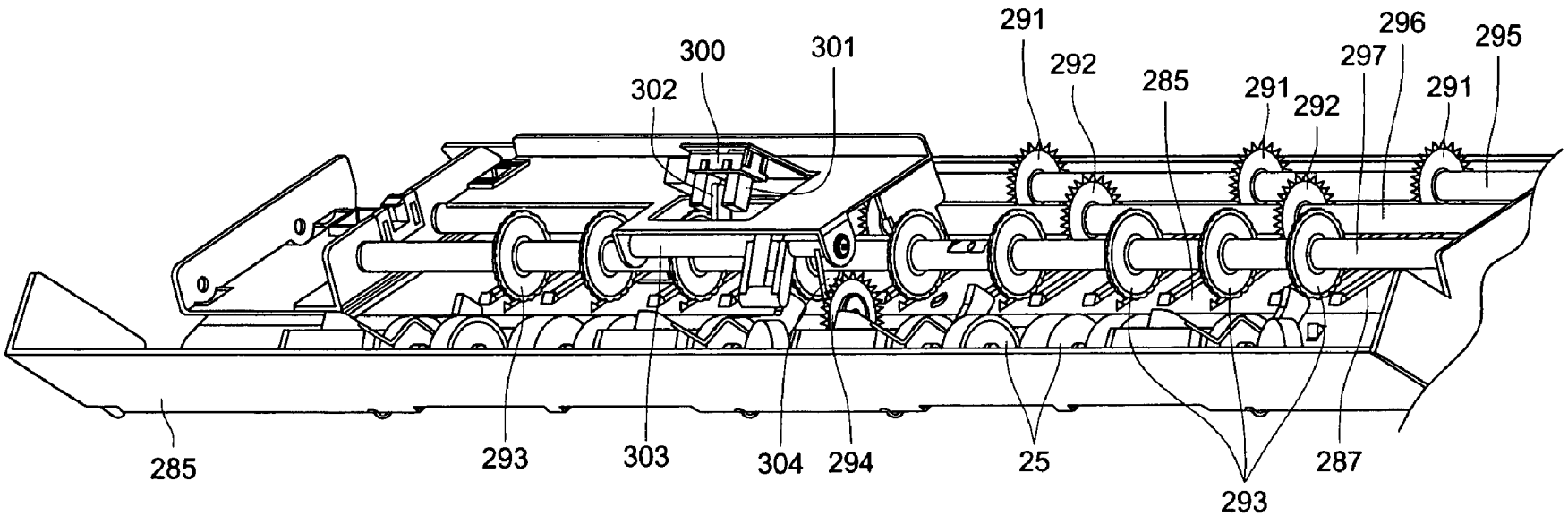
FIG. 3 shows a perspective view of the spur mechanism.

FIG. 3 shows a perspective view of the spurs 291, 292, 293 and 294, and their vicinities. As shown in this drawing, a plurality of spurs 291, 292 and 293 are respectively provided on shafts 295, 296 and 297, which are perpendicular to the conveyance direction of the transfer sheet PE. Parts of the spurs are projected towards the straight ejection path 271 through the slits 287 made on the guide plate 285.

The sensor 300 is composed of a detector 301 made of a photocoupler, a light-shielding lever 302 that moves between the light emitter and the light receiver of the detector 301, a shaft 303 that can hold the light-shielding lever 302 pivotally, a detection lever 304 projecting from this shaft 303, and a spur 294 which is pivotally mounted on the front end of the detection lever 304. In this configuration, a set of the light-shielding lever 302, the shaft 303, and the detection lever 304 constitutes an actuator. Therefore the spur 294 is on the front end of the actuator. This configuration can be substituted for a rod or plate member that can extend and shrink.

In FIG. 2, when the leading edge of the transfer sheet PE hits the spur 294, the spur 294 rotates. At the same time, the detection lever 304 rotates clockwise and the light-shielding lever is turned to let the front end go out of the detector 301. With this, the light receiver detects light coming from the light emitter of the detector 301. Then, the sensor 300 changes its status from OFF to ON to indicate that the transfer sheet PE is passing through.

FIG. 4(*a*) shows a front view of a large-projection spur having large height of teeth and FIG. 4(*b*) shows a sectional view taken on line 4(*b*)—4(*b*) in FIG. 4(*a*).

Spurs 291, 292, and 294 are large-projection spurs. FIG. 4 uses a spur 291 as a representative. The other spurs 292 and 294 are the same in shape. As shown in FIGS. 4(*a*) and 4(*b*), the spur 291 has a boss in the center and the boss center has a mounting through-hole. The circular disk of the spur 291 has equally-spaced teeth 291*a* on its circumference. As shown in FIG. 4(*b*), each tooth 291*a* has a triangular section and its outer end is sharp to make the contact area between the tooth edge and the transfer sheet PE as small as possible. The spur 291 of FIGS. 4(*a*) and 4(*b*) is 20 mm in outer diameter and has 30 teeth each of which is 1.6 mm high. This is only an example. Various spur dimensions can be selected.

FIG. 5(*a*) shows a front view of a small-projection spur 293 having small height of teeth and FIG. 5(*b*) shows a sectional view taken on line 5(*b*)—5(*b*) in FIG. 5(*a*). FIG. 5(*c*) shows a magnified view of part of FIG. 5(*a*).

This spur 293 is the same as the large-projection spur 291 in the outer diameter and the number of teeth, but its tooth is 0.24 mm, which is shorter than that of the spur 291. Further, the shape of the spur tooth 293*a* as well as the spur tooth 291*a* is triangular and its end is sharp. To realize this configuration, the spur disk has a tapered area 293*b*, which is higher than the tooth 293*a* on the circumference. The spurs 291 and 293 can be made of various kinds of materials such as synthetic resins and metals.

Next, the operations of the invention will be explained below.

The transfer sheet PE having an unfixed toner image on it is sent to the fixing device 24, and nipped by the heating roller 241 and the pressing roller 242 during which the toner is molten, pressed, and fixed to the transfer sheet PE. Then, the transfer sheet PE is sent to the changeover lever 281 from the delivery rollers 243. The changeover lever 281 is in the position indicated by a solid line of FIG. 2 and the transfer sheet PE is sent to the straight ejection path 271.

The toner molten by the heating roller 241 is solidified before the transfer sheet PE reaches the delivery rollers 243, but the wax in the toner is still molten and soft. The transfer sheet PE passes through the straight ejection path 271 with the printed side faced up (in FIG. 2) towards the spurs 291 according to the shape of the straight ejection path 271. When the leading edge of the transfer sheet PE hits the root of a tooth 291*a* of the spur 291, the spur 291 starts to rotate. As the spur 291 rotates, the leading edge of the transfer sheet PE moves up along the slope of the tooth 291*a* and reaches the top of the tooth 291*a*.

The spur 291 is designed to rotate smoothly. When the leading edge of the transfer sheet PE hits and pushes the tooth of the spur 291, the spur rotates smoothly without slipping as the transfer sheet PE advances. Then the transfer sheet PE reaches the next spurs 292 and 293 without touching the guide plate 285 and the other guide means.

Similarly, the next spur 292 and the next small-projection spur 293 rotate. Finally, the transfer sheet PE reaches the spur 294 of the sensor 300.

As the transfer sheet PE moves forward, the spur 294 of the sensor 300 rotates clockwise. This rotates the shaft 303. As the result, the light-shielding lever 302 on the shaft 303 turns to go out of the detector 301. With this, the light receiver detects light coming from the light emitter of the detector 301. The sensor 300 changes its status from OFF to ON to indicate that the leading edge of the transfer sheet PE has come. The spur 294 of the sensor 300 can also rotate smoothly without slipping against the transfer sheet PE.

As explained above, thanks to the spurs 291 through 294, the transfer sheet PE is supported and sent by spur teeth to the ejection rollers 25 without touching any guide means such as the guide plate 285 and the detection lever 304. Further, as the molten wax is solidified before the transfer sheet PE reaches the ejection rollers 25, we can get images free from unevenness of wax gloss. In the succeeding steps, the transfer sheet PE passes through the nip area of the ejection rollers 25 and is ejected to the ejection tray 26. In this case, the wax on the transfer sheet PE is already solidified and no gloss unevenness may take place.

In the above description, the straight ejection path 271 is used. Below is explained how the inversion ejection path 272 is used.

The image forming apparatus of the invention can eject paper with its sides turned over. To eject a transfer sheet with the print side faced down, set the changeover lever to the position indicated by a broken line of FIG. 2. The transfer sheet PE sent from the delivery rollers 243 enters the first inversion ejection path 272*a* and the second inversion ejection path 272*b*, and then goes downward (in FIG. 2) by the inversion rollers 27. When the trailing edge of the transfer sheet PE reaches the second inversion ejection path 272*b*, the inversion rollers 27 stop and rotate backward. The transfer sheet PE starts to move with its trailing edge as the new leading edge, and keeps on going through the third inversion ejection path 272*c*, the merging point C, and then to the ejection rollers 25.

The inversed ejection takes more time than the straight paper ejection because the inversed ejection route is longer than the straight ejection route 271 and the paper must change its moving direction. However, the image forming speed is always fixed. Therefore, the paper transfer speed must be increased in the inversed ejection.

Further, the molten wax is still soft after the transfer sheet PE passes over the spurs 291 and 292. Therefore, another spur 293 is required at a point after the merging point C. However, this spur 293 must not be a large-projection spur such as spurs 291 and 292. The reason is explained below.

The transfer sheet PE from the inversion ejection path 272 moves towards the spur 293 after the merging point C. When the fast transfer sheet PE from the inversion ejection path 272 hits the spur 293, the leading edge of the transfer sheet PE may be bent or broken if the spur 293 has a large projection as well as the spurs 291 and 292. However, without the spur 293, the molten wax in the toner is still soft in the straight paper ejection. This causes unevenness of wax gloss.

To improve this, the invention reduced the height "h" of the tooth 293*a* of the spur 293 and the projection height "H" above the guide plate 285 as shown in FIG. 5(*c*). After deliberate studies and experiments by changing "h" and "H" values, we found that the height of tooth 293*a* is not so much dependent upon the diameter of the spur and the preferred "h" value is in the range of more than 0.1 mm to less than 0.5 mm (or 0.1 mm<h<0.5 mm). The example of FIG. 5(*a*) to FIG. 5(*c*) uses "h" of 0.25 mm. If the "h" value is 0.1 mm or less, it is impossible to support the transfer sheet PE by points and a stripe of unevenness of gloss is formed. Contrarily, if the "h" value is 0.5 mm or greater, the leading edge of the transfer sheet PE is apt to be damaged.

Further, we found that the preferred projection height "H" above the guide plate 285 is in the range of 0.5 to 2.0 mm (or 0.5 mm≦H≦2.0 mm). The example of FIG. 5(*a*) to FIG. 5(*c*) uses "H" of 2.0 mm. If the "H" value is less than 0.5 mm, the transfer sheet PE directly touches the guide plate between the spurs 292 and 293. Contrarily, if the "H" value is more than 2 mm, the transfer sheet PE is apt to be damaged even when the tooth height is low.

In the conventional image forming apparatus, the detection lever 304 of the sensor 300 has nothing or simply a roller on the front end. Therefore, in the straight paper ejection, the wax on the transfer sheet PE is still soft when the sensor 300 detects the leading edge of the transfer sheet PE. The detection lever 304 or the roller on the detection lever may touch this soft wax and cause unevenness of gloss.

Contrarily, the invention provides a spur 294 on the front end of the detection lever 304. In this configuration, even when the wax on the transfer sheet PE is soft, the transfer sheet PE is supported by tooth edges of the spur 294 and the unevenness of wax gloss can be suppressed.

Figure 6:
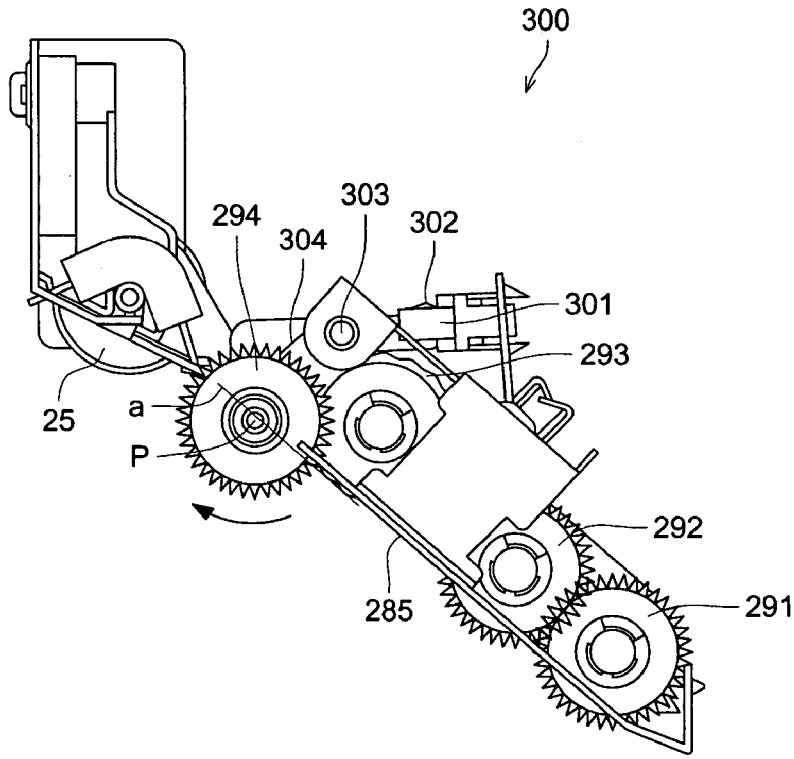
FIG. 6 is an explanatory drawing of the mounting position of the spurs.
Figure 7:
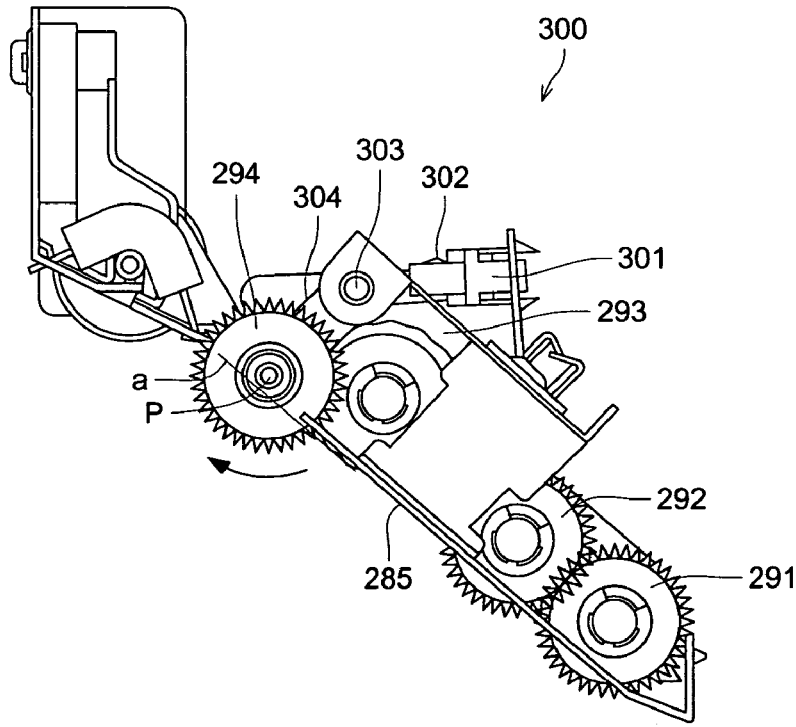
FIG. 7 is an explanatory drawing of the mounting position of the spurs.

FIG. 6 and FIG. 7 are explanatory drawings of the mounting position of the spur 294. In FIG. 6, the central axis P of the spur 294 is projected a little from the end surface "a" of the spur 293. In this configuration, when the transfer sheet PE moves along the end surface "a" and touches the spur 294, the transfer sheet PE tries to rotate the spur 294 counterclockwise. Contrarily, the detection lever 304 having the spur 294 tries to rotate clockwise around the shaft 303. Consequently, as these rotational directions are different, the spur 294 cannot rotate and a paper jam occurs.

Contrarily, in FIG. 7, the central axis P of the spur 294 is retracted a little from the end surface "a" of the spur 293. In this configuration, when the transfer sheet PE moves along the end surface "a" and touches the spur 294, the transfer sheet tries to rotate the spur 294 clockwise. Simultaneously, the detection lever 304 having the spur 294 tries to rotate clockwise around the shaft 303. As these rotational directions are the same, the spur 294 can rotate easily and the sensor 300 steadily detects the transfer sheet PE.

If the spur 294 has a small projection as well as the spur 293, the leading edge of the transfer sheet PE may be broken when it hits the spur. However, when the spur 294 has a large projection, the transfer sheet PE is not damaged. Therefore, the example indicated in the drawing uses a large-projection spur.

In the above description, the embodiment provides spurs 291 to 293 on the guide plate 285. This is because the guide means that the transfer sheet PE having molten wax may touch is the guide plate 285. Therefore, the location of the spurs is not limited to the guide plate 285 as long as the guide means may touch the molten wax.

Further, this embodiment uses three rows of spurs 291, 292, and 293. The number of rows is not limited to three as long as the wax is solidified quickly. The number of rows can be changed according to the properties of the wax.

As shown in FIG. 3, the number of small-projection spurs 293 mounted on the shaft is twice the number of large-projection spurs 291 and 292. This is because its "H" value is smaller than that of the large-projection spurs 291 and 292 as explained in FIG. 5(*a*) to FIG. 5(*c*) and more spurs 293 are required to support the transfer sheet PE to prevent the transfer sheet PE from touching the guide plate 285.

What is claimed is:

1. An image forming apparatus comprising:

(a) a fixing device that receives a recording medium having a toner image thereon, heats and presses the toner image formed on the recording medium, and fixes the toner image onto the recording medium;

(b) ejection rollers provided away from the fixing device for ejecting the recording medium;

(c) a guide provided on at least one part of a recording medium ejection path between the ejection rollers and the fixing device for guiding a conveyance of the recording medium;

(d) at least one spur provided on the guide, having a plurality of teeth on a circumference thereof; and (e) a slit formed on the guide so that the plurality of teeth of the spur are protruded on a side of the recording medium ejection path through the slit, wherein the recording medium is conveyed from the fixing device toward the ejection rollers by bringing the plurality of teeth of the spur into contact with a surface of the recording medium.

2. The image forming apparatus of claim 1, wherein the spur comprises a plurality of spurs that are spaced apart by a preset interval on a shaft extending in a direction perpendicular to a conveyance direction of the recording medium.

3. The image forming apparatus of claim 2, wherein the shaft comprises a plurality of shafts that are provided in parallel to each other along the conveyance direction.

4. The image forming apparatus of claim 1, wherein the spurs include a small-projection spur having small height of teeth in which a height of each tooth is more than 0.1 mm to less than 0.5 mm, and a height projected from a surface of the guide on the side of the recording medium ejection path is 0.5 mm to 2 mm.

5. The image forming apparatus of claim 4, wherein the recording medium ejection path has a normal-speed ejection path that conveys the recording medium at an ordinary linear speed and a high-speed ejection path that conveys the recording medium at a linear speed higher than the ordinary linear speed, and the small-projection spur is provided on the high-speed ejection path.

6. The image forming apparatus of claim 4, wherein the recording medium ejection path has a normal-speed ejection path that conveys the recording medium at an ordinary linear speed and a high-speed ejection path that conveys the recording medium at a higher linear speed higher than the ordinary linear speed, the normal-speed ejection path and high-speed ejection paths merge before the ejection rollers, and the small-projection spur is provided on a side of the ejection rollers with respect to a merging point.

7. The image forming apparatus of claim 1, wherein toner used for image formation contains wax.

* * * * *